US009059515B2

(12) United States Patent
Watanabe

(10) Patent No.: US 9,059,515 B2
(45) Date of Patent: Jun. 16, 2015

(54) DUAL BAND ANTENNA

(71) Applicant: HITACHI CABLE, LTD., Tokyo (JP)

(72) Inventor: Haruyuki Watanabe, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 255 days.

(21) Appl. No.: 13/756,329

(22) Filed: Jan. 31, 2013

(65) Prior Publication Data

US 2013/0285866 A1 Oct. 31, 2013

(30) Foreign Application Priority Data

Apr. 27, 2012 (JP) ..... 2012-103535

(51) Int. Cl.

| | |
|---|---|
| ***H01Q 13/10*** | (2006.01) |
| ***H01Q 19/30*** | (2006.01) |
| ***H01Q 5/00*** | (2006.01) |
| ***H01Q 5/40*** | (2015.01) |
| ***H01Q 5/48*** | (2015.01) |
| ***H01Q 5/49*** | (2015.01) |

(52) U.S. Cl.

CPC ..... *H01Q 13/10* (2013.01); *H01Q 19/30* (2013.01); *H01Q 5/40* (2015.01); *H01Q 5/48* (2015.01); *H01Q 5/49* (2015.01)

(58) Field of Classification Search

CPC . H01Q 5/0072; H01Q 5/0086; H01Q 5/0089; H01Q 19/28; H01Q 19/30; H01Q 13/10

USPC ..... 343/770

See application file for complete search history.

(56) References Cited

U.S. PATENT DOCUMENTS

| | | | | |
|---|---|---|---|---|
| 4,290,071 | A * | 9/1981 | Fenwick | 343/819 |
| 2004/0070548 | A1* | 4/2004 | Cake | 343/803 |
| 2005/0162328 | A1* | 7/2005 | Mori | 343/770 |
| 2006/0044200 | A1* | 3/2006 | Mori | 343/770 |
| 2007/0229357 | A1* | 10/2007 | Zhang et al. | 343/700 MS |
| 2009/0174557 | A1* | 7/2009 | Nikitin et al. | 340/572.7 |
| 2010/0220027 | A1* | 9/2010 | Mori | 343/818 |
| 2011/0187616 | A1* | 8/2011 | Iso et al. | 343/725 |

FOREIGN PATENT DOCUMENTS

| | | | |
|---|---|---|---|
| JP | 63-174412 | A | 7/1988 |
| JP | 2010-093587 | A | 4/2010 |

* cited by examiner

*Primary Examiner* — Dameon E Levi
*Assistant Examiner* — Jennifer F Hu
(74) *Attorney, Agent, or Firm* — McGinn IP Law Group, PLLC

(57) ABSTRACT

A dual band antenna providing a high forward gain includes a radiator, a director disposed in front of the radiator, and a reflector disposed behind the radiator. A dual resonance notch antenna including a conducting plate and a feeding portion is used as the radiator. The director includes a conducting plate and a short-circuiting portion and the reflector includes a conducting plate and a short-circuiting portion. Each conducting plate is disposed such that the direction of a normal to the conducting plate is a front-rear direction. Two slots having different lengths are formed in each conducting plate so as to be aligned with each other. The feeding portion is disposed in one of the slots. Each short-circuiting portion is disposed in one of the two slots at a position corresponding to the feeding portion.

5 Claims, 7 Drawing Sheets

Related Art

DUAL BAND ANTENNA

The present application is based on Japanese patent application No. 2012-103535 filed on Apr. 27, 2012, the entire contents of which are incorporated herein by reference.

BACKGROUND OF THE INVENTION

1. Field of the Invention

The present invention relates to dual band antennas.

2. Description of the Related Art

A Yagi-Uda antenna is widely known as an antenna providing a high gain in a specific direction and having a directional radiation pattern. The Yagi-Uda antenna includes a radiator formed of a dipole antenna, a director disposed in front of the radiator, and a reflector disposed behind the radiator to improve the front-to-back ratio (F/B ratio) or the forward gain.

The Yagi-Uda antenna can only cover a single frequency band. If dual frequency bands need to be covered, a Yagi-Uda antenna 81 for covering a low frequency band and a Yagi-Uda antenna 82 for covering a high frequency band need to be formed and combined with each other as illustrated in FIGS. 8A and 8B. In FIGS. 8A and 8B, the reference numeral 83 denotes a radiator, the reference numeral 84 denotes a director, and the reference numeral 85 denotes a reflector. The polarization orientation of the Yagi-Uda antennas 81 and 82 is the same as the longitudinal direction of the radiator 83 (width direction of the antennas).

SUMMARY OF THE INVENTION

Japanese Unexamined Patent Application Publications JP-A-2010-93587 and JP-A-63-174412 describe technologies related to the present application.

The combination of two Yagi-Uda antennas, however, requires multiple, specifically, two feed points. This configuration needs a distributor, causing an increase in component costs. Concurrently, design of the distributor in addition to that of the antennas is required as an extra job.

Although various antennas providing a favorable front-to-back ratio or a high forward gain have been developed, there is currently no dual band directional antenna having a single feed point.

The present invention has been accomplished in view of the above circumstances and an object of the present invention is to provide a dual band antenna providing a high gain in a predetermined direction, having a directional radiation pattern, and having a single feed point.

According to one exemplary aspect of the present invention made to achieve the above object, a dual band antenna providing a high forward gain includes a radiator, a director disposed in front of the radiator, and a reflector disposed behind the radiator. In the dual band antenna, the radiator includes a dual resonance notch antenna including a conducting plate and a feeding portion, the conducting plate being disposed such that the direction of a normal to the conducting plate is a front-rear direction, two slots having different lengths being formed in the conducting plate so as to be aligned with each other, and the feeding portion being disposed in one of the slots. In the dual band antenna, the director includes a conducting plate and a short-circuiting portion and the reflector includes a conducting plate and a short-circuiting portion, each of the conducting plates being disposed such that the direction of a normal to the conducting plate is the front-rear direction, two slots having different lengths being formed in each of the conducting plates so as to be aligned with each other, and each of the short-circuiting portions being disposed in one of the two slots at a position corresponding to the feeding portion in the dual resonance notch antenna.

In the above exemplary invention, many exemplary modifications and changes can be made as below.

(i) The dual resonance notch antenna includes the conducting plate, which is rectangular; the two slots having different lengths, the slots being formed in a middle portion of the conducting plate in a short-side direction of the conducting plate so as to be aligned with each other in a long-side direction of the conducting plate, the slots being open at opposite sides from each other; a connecting portion that is formed between the two slots, the connecting portion electrically connecting an upper portion and a lower portion of the conducting plate, which are located above and below the two slots, with each other; and the feeding portion disposed in a shorter one of the two slots at a position near the connecting portion.

(ii) The conducting plate used for the director has shorter dimensions in the short-side direction and the long-side direction than the conducting plate used for the radiator, and the conducting plate used for the reflector has longer dimensions in the short-side direction and the long-side direction than the conducting plate used for the radiator.

(iii) A distance between the radiator and the director and a distance between the radiator and the reflector are set so as to fall within the range of $0.028\lambda_L$ to $0.125\lambda_L$, inclusive, and within the range of $0.096\lambda_H$ to $0.249\lambda_H$, inclusive, where a low frequency wavelength is denoted by $\lambda_L$ and a high frequency wavelength is denoted by $\lambda_H$.

(iv) A distance between the radiator and the director and a distance between the radiator and the reflector are set such that the sum of a forward gain and a front-to-back ratio at a low frequency and a forward gain and a front-to-back ratio at a high frequency is 36 dB or greater.

The present invention can provide a dual band antenna providing a high gain in a predetermined direction, having directionality in a radiation pattern, and having a single feed point.

BRIEF DESCRIPTION OF THE DRAWINGS

The foregoing and other exemplary purposes, aspects and advantages will be better understood from the following detailed description of the invention with reference to the drawings, in which.

DESCRIPTION OF THE PREFERRED EMBODIMENTS

Hereinbelow, an embodiment of the present invention will be described with reference to the attached drawings.

Figure 1A:
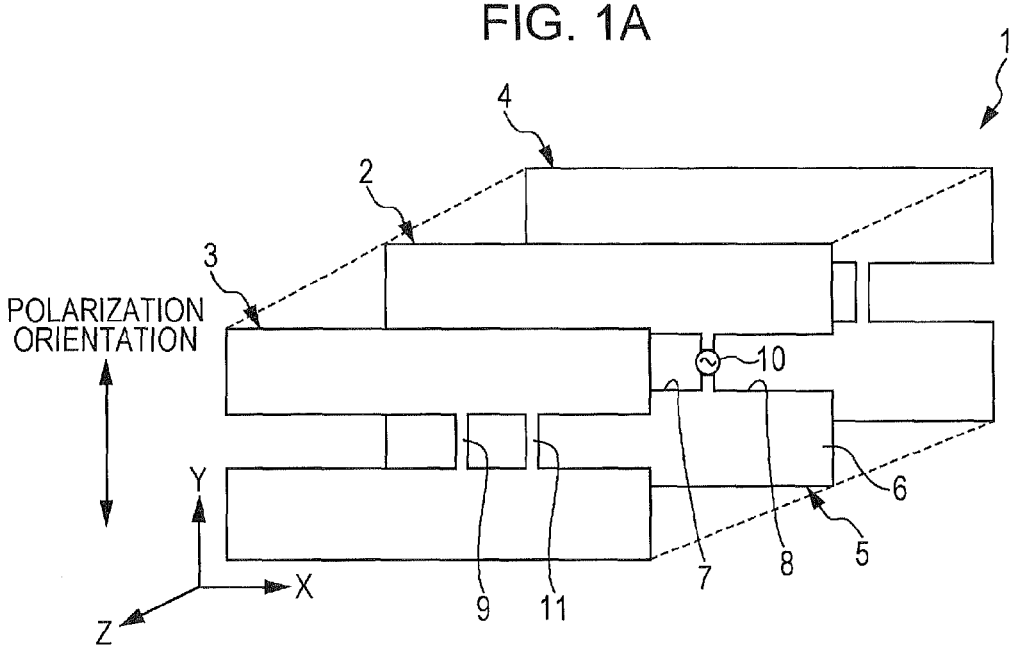
FIG. 1A is a perspective view of a dual band antenna according to an embodiment of the present invention.
Figure 1B:
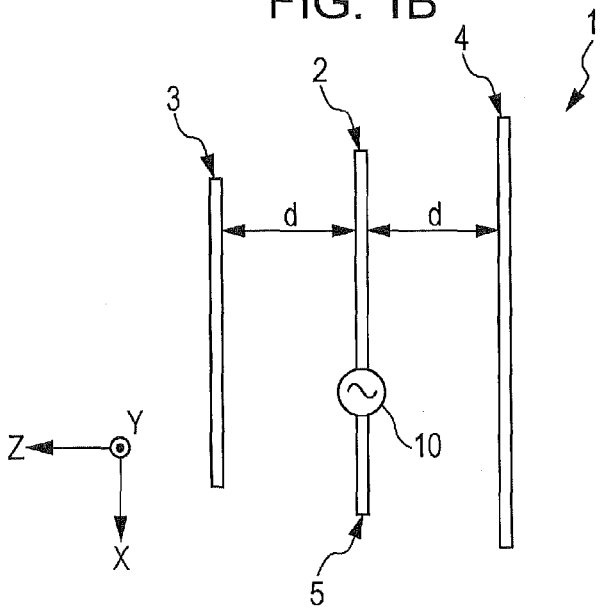
FIG. 1B is a top view of the dual band antenna.
Figure 2A:
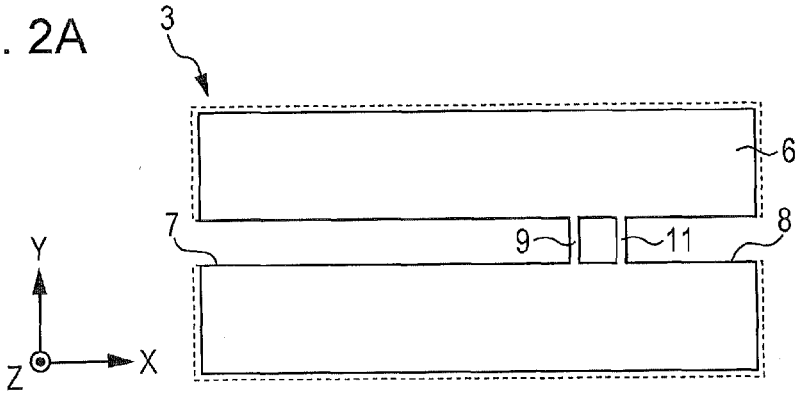
FIG. 2A is a plan view of a director of the dual band antenna illustrated in FIGS. 1A and 1B.
Figure 2B:
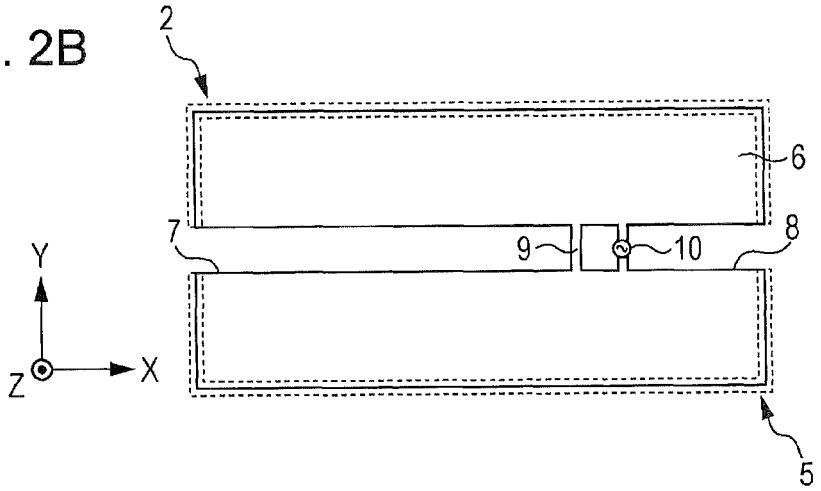
FIG. 2B is a plan view of a radiator of the dual band antenna illustrated in FIGS. 1A and 1B.
Figure 2C:
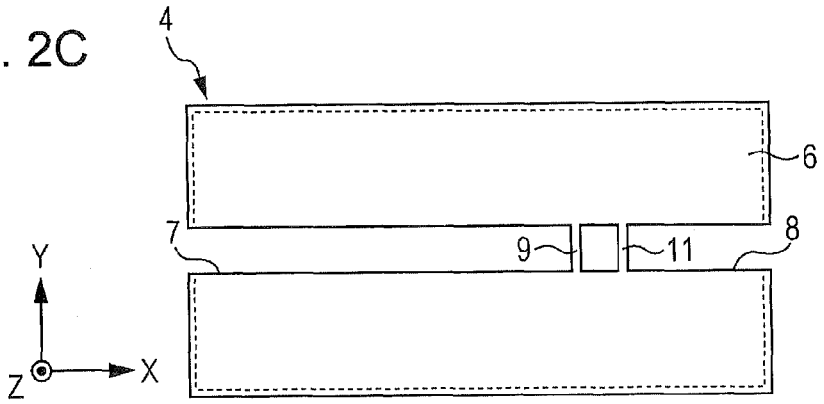
FIG. 2C is a plan view of a reflector of the dual band antenna illustrated in FIGS. 1A and 1B.

FIG. 1A is a perspective view of a dual band antenna 1 according to the embodiment and FIG. 1B is a top view of the dual band antenna. FIG. 2A is a plan view of a director 3 of the dual band antenna, FIG. 2B is a plan view of a radiator 2 of the dual band antenna, and FIG. 2C is a plan view of a reflector 4 of the dual band antenna.

As illustrated in FIGS. 1A, 1B, and 2A to 2C, the dual band antenna 1 is a directional antenna having a Yagi-Uda antenna structure including a radiator 2, a director 3 disposed in front of the radiator 2, and a reflector 4 disposed behind the radiator 2 to provide a high forward gain.

Although an ordinary Yagi-Uda antenna includes a dipole antenna, the dual band antenna 1 according to the embodiment instead includes a dual resonance notch antenna 5 as the radiator 2.

The dual resonance notch antenna 5 is formed of a conducting plate 6 having two slots 7 and 8, in either of which a feeding portion 10 is formed. The conducting plate 6 is disposed such that the direction of the normal to the conducting plate 6 is the front-rear direction (Z-axis direction in the drawings). The two slots 7 and 8 have different lengths and are aligned with each other.

More specifically, the dual resonance notch antenna 5 includes a rectangular conducting plate 6, two slots 7 and 8 having different lengths, a connecting portion 9 formed between the two slots 7 and 8, and a feeding portion 10 formed in the slot 8, which is shorter than the slot 7, at a position near the connecting portion 9. The two slots 7 and 8 are formed in a middle portion in the direction in which the short sides of the conducting plate 6 extend (in the Y-axis direction in the drawings). The two slots 7 and 8 extend in the direction in which the long sides of the conducting plate 6 extend (in the X-axis direction in the drawings) and are aligned with each other. The two slots 7 and 8 are open at opposite sides from each other. The connecting portion 9 electrically connects upper and lower portions of the conducting plate 6, which are located above and below the two slots 7 and 8, with each other.

The conducting plate 6 may be a metal plate, such as a copper plate, or may be a board made of a material such as glass epoxy resin on which a conductive pattern is formed. In the case of using a board, a single-sided board on which gap feed is performed may be used. Alternatively, a double-sided board on which three dimensional feed is performed may be used. In the embodiment, feed is performed by electrically connecting a coaxial cable, not illustrated, directly to the feeding portion 10.

The slots 7 and 8 are rectangular and have the same width (dimension in the Y-axis direction in the drawings). Thus, a portion of the conducting plate 6 that is left between the slots 7 and 8 after the slots 7 and 8 are formed in the conducting plate 6 becomes the connecting portion 9.

In this configuration, when power is fed to the feeding portion 10, an electric current distribution in the slot 7 and an electric current distribution in the slot 8 overlap each other and thus the two slots 7 and 8 operate as notch elements with a single feed point.

In other words, when two slots 7 and 8 having different lengths, a connecting portion 9, and a feeding portion 10 are formed in the conducting plate 6 and when power is fed to the feeding portion 10, a dual resonance notch antenna 5 with a single feed point is obtained in which the two slots 7 and 8 operate as notch elements that resonate with different frequencies.

Figure 3:
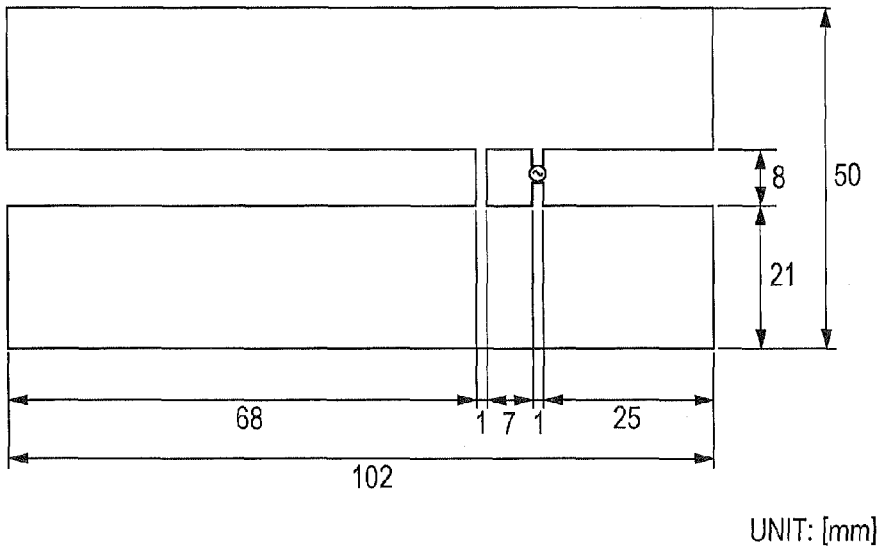
FIG. 3 illustrates an example of dimensions of portions of the radiator.

The length of the conducting plate 6 in the direction in which the long sides extend and the length of the slots 7 and 8 mainly affect the resonance frequency and thus may be appropriately determined in accordance with a desired resonance frequency. The length of the conducting plate 6 in the direction in which the short sides extend mainly affects a gain and thus may be appropriately determined such that a desired gain is provided. In the embodiment, on the assumption that the antenna is used in a mobile phone base station, the dimensions of portions of the radiator 2 (dual resonance notch antenna 5) are determined as illustrated in FIG. 3, a lower resonance frequency is set at 850 MHz, and a higher resonance frequency is set at 1700 MHz. The resonance frequency to be set is not limited to the above examples. However, in order to reliably achieve effects of the invention, desirably, the higher resonance frequency is approximately two times as high as the lower resonance frequency.

An element formed of a conducting plate 6 and including a short-circuiting portion 11 is used as the director 3 and an element formed of a conducting plate 6 and including a short-circuiting portion 11 is used as the reflector 4. Each of the conducting plates 6 is disposed such that the direction of a normal to the conducting plate 6 is the front-rear direction. Two slots having different lengths are formed in each of the conducting plates 6 so as to be aligned with each other. Each of the short-circuiting portions 11 is disposed in one of the two slots at a position corresponding to the feeding portion 10. Hereinbelow, these short-circuiting portions 11 are referred to as second short-circuiting portions 11.

The conducting plate 6 that forms the director 3 has dimensions in the directions in which the short sides and long sides extend shorter than those of the conducting plate 6 that forms the radiator 2. In the embodiment, the dimensions (the dimension in long side direction×the dimension in short side direction) of the radiator 2 are set at 102 mm×50 mm. The dimensions of the director 3 are smaller than those of the radiator 2 and are set at 100 mm×48 mm in the embodiment.

The conducting plate 6 that forms the reflector 4 has dimensions in the directions in which the short sides and long sides extend longer than those of the conducting plate 6 that forms the radiator 2. In the embodiment, the dimensions of the reflector 4 are set at 104 mm×52 mm. The dimensions in which the short sides and long sides of the conducting plate 6 extend increase by 2 mm in the order of the conducting plate 6 for the director 3, that for the radiator 2, and that for the reflector 4.

In FIGS. 2A and 2C, the radiator 2 is drawn in broken lines. In FIG. 2B, the director 3 and the reflector 4 are drawn in broken lines. As illustrated in FIGS. 2A to 2C, the radiator 2, the director 3, and the reflector 4 differ only in the size of the conducting plates 6 and the dimensions of other portions are the same. In the dual band antenna 1, the radiator 2, the director 3, and the reflector 4 are disposed such that, when the dual band antenna 1 is seen from the front, the connecting portions 9 of the radiator 2, the director 3, and the reflector 4 are superposed on one another and the feeding portion 10 and the second short-circuiting portions 11 are superposed on one another.

Figure 4:
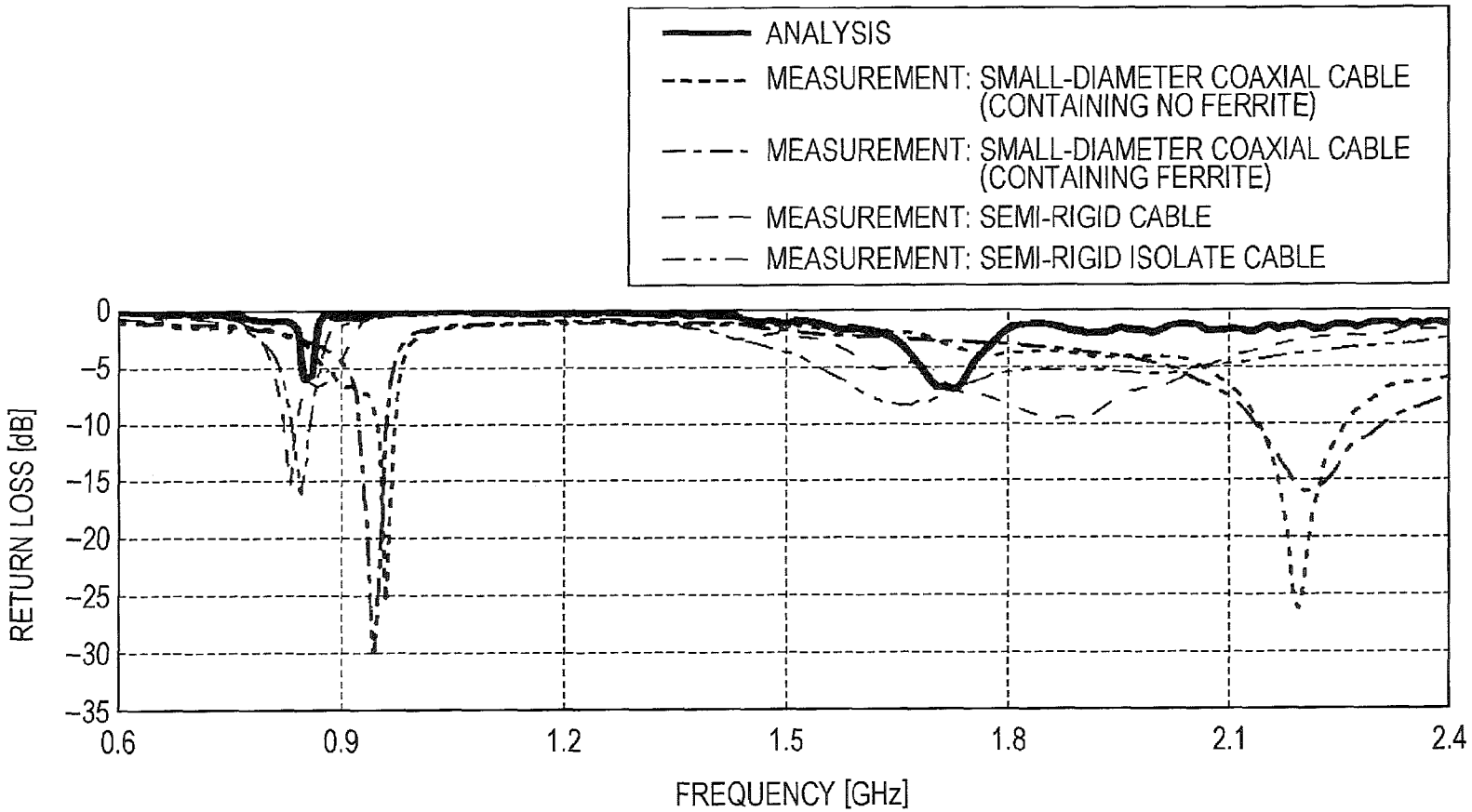
FIG. 4 is a graph showing return loss of the dual band antenna illustrated in FIGS. 1A and 1B.

FIG. 4 illustrates analytical results and actual measurements to find the return loss of the dual band antenna 1. Actual measurements were performed to observe the effect of feeder cables. For this purpose, a small-diameter coaxial cable (containing no ferrite), a small-diameter coaxial cable (containing ferrite), a semi-rigid cable, and a semi-rigid isolate cable were used as examples of the feed cables. FIG. 4 shows the case where an inter-element distance d between the radiator 2 and the director 3 and an inter-element distance d between the radiator 2 and the reflector 4 are set at 28 mm.

As illustrated in FIG. 4, the analytical result of the return loss of the dual band antenna 1 at the frequency of 850 MHz is approximately −5.5 dB, and the analytical result of the return loss of the dual band antenna 1 at the frequency of 1700 MHz is approximately −6.5 dB. These results show that the dual band antenna 1 operates sufficiently well to function as an antenna. In the dual band antenna 1, the polarization at the low and high frequencies is oriented in the same direction as the short-side direction of the conducting plate 6 (Y-axis direction). That is, the polarization is linear polarization.

The actual measurements that are nearest to these analytical results were obtained in the case where a semi-rigid isolate cable was used as a feeder cable. In this case, the actual measurement of the return loss at the frequency of 850 MHz was approximately −13.3 dB, and the actual measurement of the return loss at the frequency of 1700 MHz was approximately −7.6 dB. In the case where each of the small-diameter coaxial cables was used as a feeder cable, a large loss occurred in the feeder cable and the return loss lowered significantly. Moreover, the resonance frequency was deviated to be higher than the analytical result of the resonance frequency as a result of part of the feeder cable having operated as part of the antenna. Here, the semi-rigid cable is a coaxial cable having an exterior conductor formed of a metal pipe made of copper, nickel, or stainless steel. The semi-rigid isolate cable is a cable in which a semi-rigid cable is used as a feeder cable and an isolate cable (also referred to as an "isolating cable") is connected between the dual band antenna 1 and the feeder cable to reduce electromagnetic interference between the dual band antenna 1 and the feeder cable.

These results show that, in the case where the dual band antenna 1 is used as a receiving antenna that receives digital terrestrial television broadcasting or the like, it is preferable to use a semi-rigid isolate cable or the like as a feeder cable to feed power while the effect of the feeder cable is reduced as much as possible. This configuration enables transmission of a received radio wave to a demodulator while the loss in the feeder cable is kept low. Thus, the amount of amplification of an amplifier can be reduced.

In the case where the dual band antenna 1 is used as a transmitting/receiving antenna of a device such as a mobile phone or a wireless LAN, it is preferable to use a coaxial cable such as a small-diameter coaxial cable as a feeder cable to lower the return loss and increase the band width. The deviation of the resonance frequency resulting from the use of the small-diameter coaxial cable as a feeder cable can be easily adjusted by individually adjusting the lengths of the slots 7 and 8.

Figure 5A:
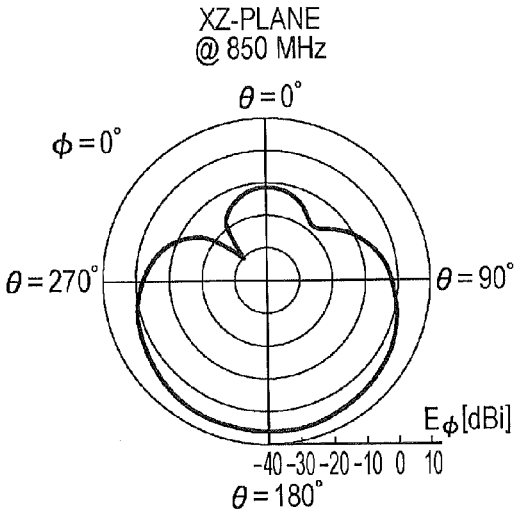
FIGS. 5A to 5D illustrate radiation patterns of the dual band antenna illustrated in FIGS. 1A and 1B.
Figure 5B:
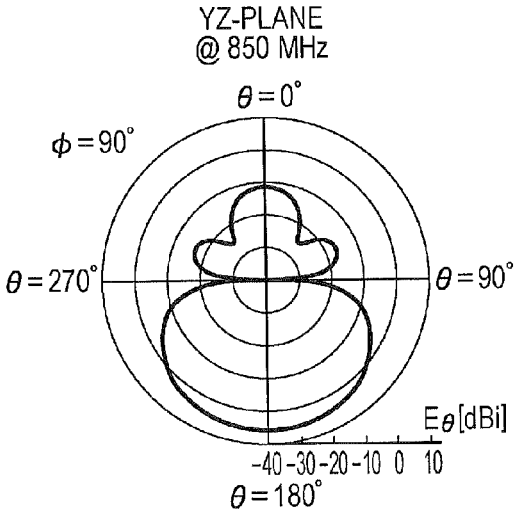
Figure 5C:
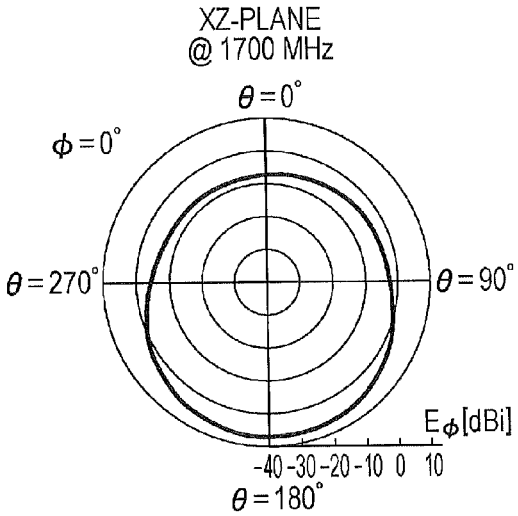
Figure 5D:
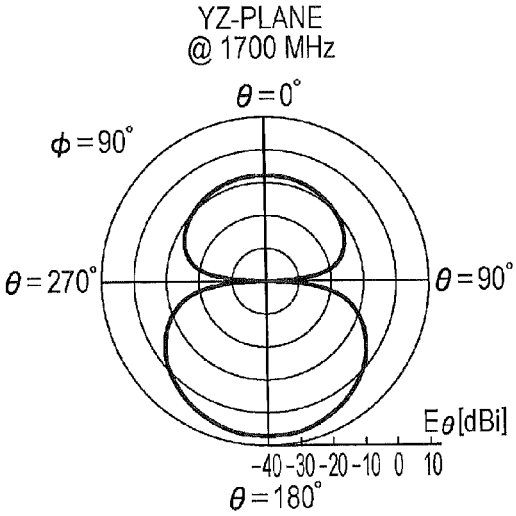
Figure 6:
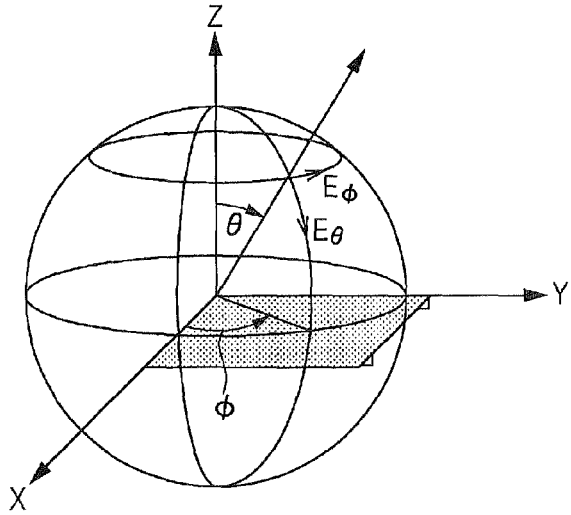
FIG. 6 illustrates reference symbols used for illustrating the radiation patterns in FIGS. 5A to 5D.

FIGS. 5A to 5D illustrate radiation patterns of the dual band antenna 1. Referring to FIG. 6 together, FIGS. 5A and 5C each illustrate a radiation pattern of vertical polarization $E_\phi$ on the XZ-plane in which the angle $\phi$ with respect to the X-axis is 0°. FIGS. 5B and 5D each illustrate a radiation pattern of vertical polarization $E_\theta$ on the YZ-plane in which the angle $\phi$ with respect to the X-axis is 90°. When the XZ-plane is assumed to be the ground (horizontal plane), $E_\phi$ is vertical polarization and $E_\theta$ is horizontal polarization. When the YZ-plane is assumed to be the ground (horizontal plane), $E_\phi$ is horizontal polarization and $E_\theta$ is vertical polarization. In FIGS. 5A to 5D, the direction in which $\theta$=180° is the front direction of the dual band antenna 1.

As illustrated in FIGS. 5A to 5D, the dual band antenna 1 provides a large forward gain and a small rearward gain at both the low frequency (850 MHz) and the high frequency (1700 MHz) and thus provides a large front-to-back ratio.

Now, the inter-element distance d is examined.

By changing the inter-element distance d within a range of 11 mm to 88 mm, the forward gain and the front-to-back ratio (F/B ratio) at the frequencies of 850 MHz and 1700 MHz were calculated by simulation. The calculated results are shown in Table 1 and FIG. 7. In the embodiment, in order to comprehensively evaluate the forward gain and the front-to-back ratio, the sum of the forward gain (dB) and the front-to-back ratio (dB) at the low frequency and the forward gain (dB) and the front-to-back ratio (dB) at the high frequency (forward gains+front-to-back ratios) is used as an evaluation parameter. The evaluation parameter (the sum of the forward gains+the front-to-back ratios) is also shown in Table 1 and FIG. 7.

TABLE 1

| | 850 MHz | | | 1700 MHz | | | Sum of |
|---|---|---|---|---|---|---|---|
| Inter-Element Distance (mm) | Forward Gain (dB) | Rearward Gain (dB) | F/B Ratio (dB) | Forward Gain (dB) | Rearward Gain (dB) | F/B Ratio (dB) | Forward Gains + F/B Ratios |
| 11 | 1.22 | −3.87 | 5.09 | 4.34 | −10.21 | 14.55 | 25.2 |
| 22 | 3.53 | −11 | 14.53 | 4.81 | −8.68 | 13.49 | 36.36 |
| 25 | 3.78 | −13.2 | 16.98 | 5.02 | −10.14 | 15.16 | 40.94 |
| 28 | 4.09 | −14.13 | 18.22 | 5.1 | −9.47 | 14.57 | 41.98 |
| 31 | 4.31 | −11.93 | 16.24 | 5.4 | −8.74 | 14.14 | 40.09 |
| 33 | 4.4 | −11.06 | 15.46 | 5.39 | −7.49 | 12.88 | 38.13 |
| 44 | 4.69 | −11.41 | 16.1 | 5.49 | −1.06 | 6.55 | 32.83 |
| 66 | 5.25 | −19.02 | 24.27 | 2.1 | 0.27 | 1.83 | 33.45 |
| 88 | 5.48 | −3.99 | 9.47 | −6.08 | −6.35 | 0.27 | 9.14 |

Figure 7:
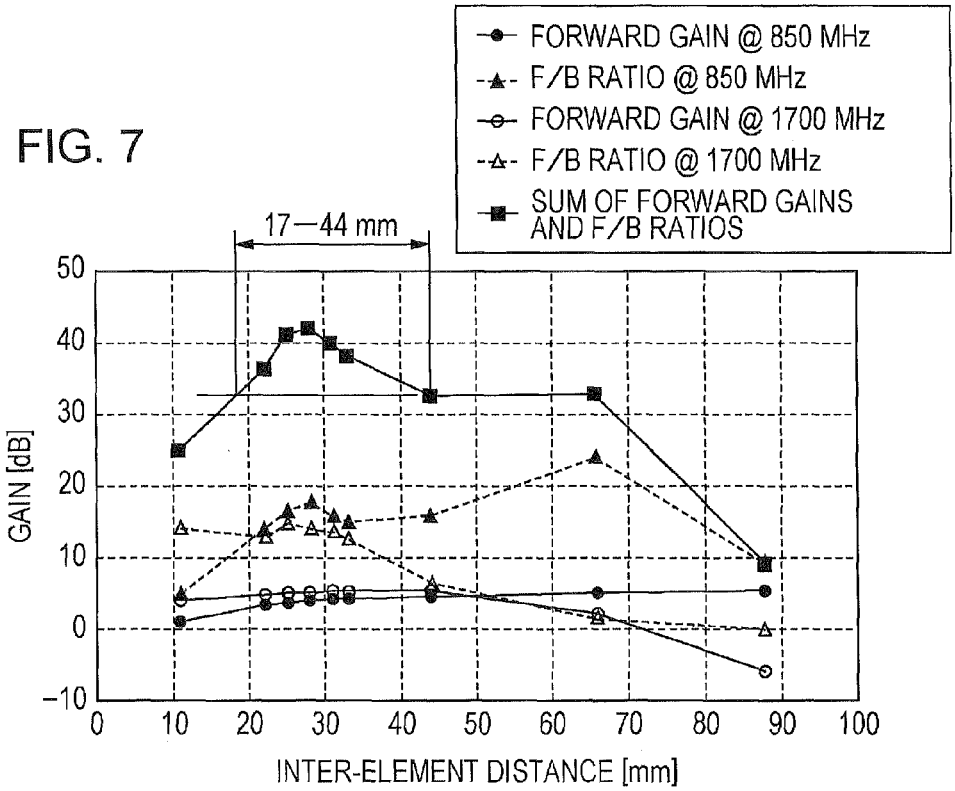
FIG. 7 is a graph showing the relationship between an inter-element distance in the dual band antenna and the sum of a forward gain and a front-to-back ratio of the dual band antenna illustrated in FIGS. 1A and 1B, the inter-element distance being a distance between the radiator and the director and between the radiator and the reflector.

As illustrated in Table 1 and FIG. 7, when the inter-element distance d falls within the range of 17 mm to 44 mm, a large evaluation parameter (the sum of forward gains+F/B ratios) is obtained. Thus, preferably, the inter-element distance d falls within the range of 17 mm to 44 mm. When the inter-element distance d is converted into the wavelength for generalization and when the low frequency wavelength is denoted by $\lambda_L$ and the high frequency wavelength is denoted by $\lambda_H$, preferably, the inter-element distance d falls within the range of $0.028\lambda_L$ to $0.125\lambda_L$, inclusive, and within the range of $0.096\lambda_H$ and $0.249\lambda_H$, inclusive.

It is said that a typical Yagi-Uda antenna including a dipole antenna has good properties if the antenna provides a forward gain of approximately 5 dB and a front-to-back ratio of approximately 13 dB. Thus, the sum of the forward gain and the front-to-back ratio at the low frequency and the sum of the forward gain and the front-to-back ratio at the high frequency are each preferably 18 dB or higher, and accordingly, the sum of the forward gains and the front-to-back ratios at the low and high frequencies is preferably 36 dB or greater. In other words, it is more preferable that the inter-element distance d is set such that the sum of the forward gain (dB) and the front-to-back ratio (dB) at the low frequency and the forward gain (dB) and the front-to-back ratio (dB) at the high frequency is 36 dB or greater.

As is found from Table 1 and FIG. 7, the largest evaluation parameter (forward gains+F/B ratios) is obtained when the inter-element distance d is 28 mm. Thus, the optimum inter-element distance d is 28 mm, which is equivalent to $0.079\lambda_L$ and $0.159\lambda_H$.

Now, operations of the embodiment will be described.

The dual band antenna 1 according to the embodiment includes a radiator 2, a director 3 disposed in front of the radiator 2, and a reflector 4 disposed behind the radiator 2 to provide a high forward gain. In the dual band antenna 1, a dual resonance notch antenna 5 is used as the radiator 2. The dual resonance notch antenna 5 is formed of a conducting plate 6 disposed such that the direction of the normal to the conducting plate 6 is the front-rear direction. In the conducting plate 6, two slots 7 and 8 having different lengths are formed so as to be aligned with each other and a feeding portion 10 is formed in either the slot 7 or 8. An element formed of a conducting plate 6 and including a short-circuiting portion 11 is used as the director 3 and an element formed of a conducting plate 6 and including a short-circuiting portion 11 is used as the reflector 4. Each of the conducting plates 6 is disposed such that the direction of a normal to the conducting plate 6 is the front-rear direction. Two slots 7 and 8 having different lengths are formed in each of the conducting plates 6 so as to be aligned with each other. Each of the short-circuiting portions 11 is disposed in one of the two slots 7 and 8 at a position corresponding to the feeding portion 10.

With this configuration, a dual band Yagi-Uda antenna with a single feed point can be formed, and thus a dual band antenna 1 providing a high gain in a predetermined direction, whose radiation pattern is directional, and having a single feed point can be formed. Since this antenna can dispense with a distributor which is required in an existing antenna, component costs and design effort can be reduced. Furthermore, the antenna achieves a dual band operation only by using a single element unlike in the traditional case where two elements are combined. Thus, the antenna can be easily formed without combining two elements.

The inter-element distance d between the radiator 2 and the director 3 and the inter-element distance d between the radiator 2 and the reflector 4 are set so as to fall within the range of $0.028\lambda_L$ to $0.125\lambda_L$, inclusive, and within the range of $0.096\lambda_H$ to $0.249\lambda_H$, inclusive. By setting the inter-element distances d in the above manner, a favorable forward gain and a favorable front-to-back ratio can be obtained at both the low and high frequencies by increasing the directionality using the director 3 and the reflector 4.

Figure 8A:
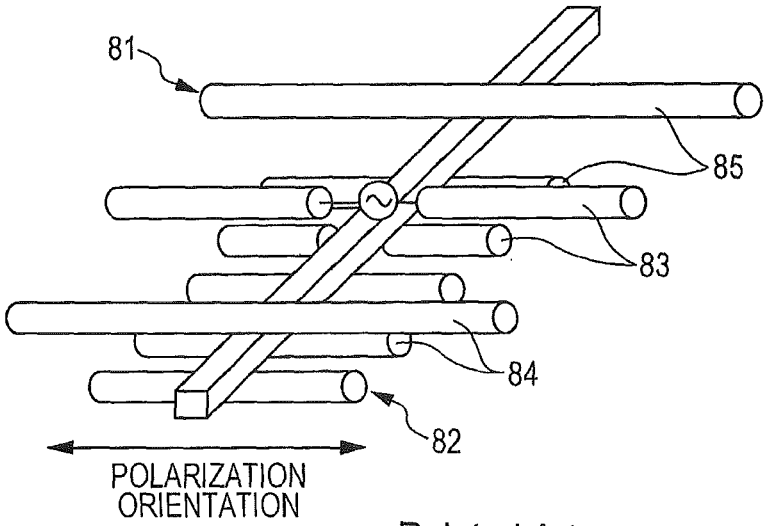
FIG. 8A is a perspective view of an existing dual band antenna.
Figure 8B:
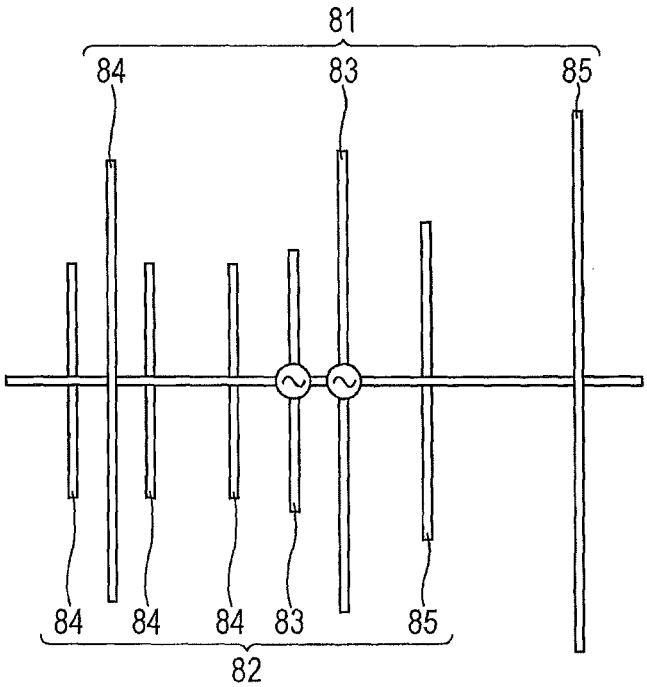
Related Art FIG. 8B
FIG. 8B is a top view of the existing dual band antenna.

A dual band antenna including an existing dipole antenna has a large width that extends in the same direction as the polarization orientation (see FIG. 8A). However, the dual band antenna 1 according to the embodiment has a small width that extends in the same direction as the polarization orientation (extends in the Y-axis direction), but a large width that extends in the same direction as a direction orthogonal to the polarization orientation (extends in the X-axis direction). In other words, the existing dual band antenna and the dual band antenna 1 according to the embodiment are installed in spaces having different shapes extending in different directions. Thus, the dual band antenna 1 according to the embodiment can be installed in a narrow space in which the existing Yagi-Uda antenna cannot be installed.

Furthermore, the gain provided by the dual band antenna 1 can be adjusted by adjusting the length of the conducting plate 6 in the short-side direction. Increasing the number of directors has been the only possible way to improve the front-to-back ratio and the forward gain, but increasing the number of directors increases the entire size of the antenna in the front-rear direction by approximately ¼λ×the number of directors. However, according to the embodiment of the present invention, the front-to-back ratio and the forward gain can be improved by increasing the length of the conducting plate 6 in the short-side direction and by increasing the area of the conducting plate 6 around the slots 7 and 8.

In addition, by using the method according to the embodiment, with which the gain is increased by increasing the length of the conducting plate 6 in the short-side direction, in combination with the existing method of increasing the gain by increasing the number of directors 3, the gain can be increased by a larger amount than in the case of simply using the existing method.

The dual band antenna 1 according to the embodiment of the invention can be used as, for example, a relay antenna, a base station antenna, or a broadcast receiving antenna, and is favorably applicable to a telecommunication system such as a mobile phone network, a wireless LAN, or digital terrestrial television broadcasting.

The present invention is not limited to the above-described embodiment, and can be modified in various manners within a scope not departing from the gist of the invention.

Further, it is noted that Applicant's intent is to encompass equivalents of all claim elements, even if amended later during prosecution.

What is claimed is:

1. A dual band antenna providing a high forward gain, comprising:

a radiator;

a director disposed in front of the radiator; and a reflector disposed behind the radiator, wherein the radiator comprises a dual resonance notch antenna including a first conducting plate, a feeding portion, and a first two slots formed in the first conducting plate, wherein the first two slots have different lengths and are aligned with each other, and wherein the feeding portion is disposed in one of the first two slots, and wherein the director comprises a second conducting plate, a first short-circuiting portion and a second two slots formed in the second conducting plate, wherein the second two slots have different lengths and are aligned with each other, and wherein the first short-circuiting portion is disposed in one of the second two slots at a position corresponding to the feeding portion in the dual resonance notch antenna;

wherein the reflector comprises a third conducting plate, a second short-circuiting portion, and a third two slots formed in the third conducting plate, wherein the third two slots have different lengths and are aligned with each other, wherein the second short-circuiting portion is disposed in one of the third two slots at a position corresponding to the feeding portion in the dual resonance notch antenna;

wherein each of the first, second and third conducting plates is disposed such that the direction of a normal to the conducting plates is the front-rear direction.

2. The dual band antenna according to claim 1, wherein the dual resonance notch antenna includes the first conducting plate, which is rectangular, the first two slots having different lengths, the first two slots being formed in a middle portion of the first conducting plate in a short-side direction of the first conducting plate so as to be aligned with each other in a long-side direction of the first conducting plate, the first two slots being open at opposite sides from each other, a connecting portion that is formed between the first two slots, the connecting portion electrically connecting an upper portion and a lower portion of the conducting plate, wherein the upper portion and the lower portion of the conducting plate are located above and below the two slots, and the feeding portion disposed in a shorter one of the first two slots at a position near the connecting portion.

3. The dual band antenna according to claim 2, wherein the second conducting plate of the director has shorter dimensions than the conducting plate of the radiator, and wherein the third conducting plate of the reflector has longer dimensions than the conducting plate of the radiator.

4. The dual band antenna according to claim 1, wherein a distance between the radiator and the director and a distance between the radiator and the reflector are set so as to fall within the range of $0.028\lambda_L$ to $0.125\lambda_L$, inclusive, and within the range of $0.096\lambda_H$ to $0.249\lambda_H$, inclusive, where a low frequency wavelength is denoted by $\lambda_L$ and a high frequency wavelength is denoted by $\lambda_H$.

5. The dual band antenna according to claim 1, wherein a distance between the radiator and the director and a distance between the radiator and the reflector are set such that the sum of a forward gain and a front-to-back ratio at a low frequency and a forward gain and a front-to-back ratio at a high frequency is 36 dB or greater.

* * * * *